US008959789B2

(12) United States Patent
Sans Rovira et al.

(10) Patent No.: US 8,959,789 B2
(45) Date of Patent: Feb. 24, 2015

(54) TUNNEL-TYPE ROTARY-DRUM TUMBLE DRYER

(75) Inventors: Ramón Sans Rovira, VIC Barcelona (ES); Daniel Arcarons Alibes, VIC Barcelona (ES); Jordi Garcia Ferrera, VIC Barcelona (ES)

(73) Assignee: Girbau, S.A. (ES)

( * ) Notice: Subject to any disclaimer, the term of this patent is extended or adjusted under 35 U.S.C. 154(b) by 661 days.

(21) Appl. No.: 13/322,570

(22) PCT Filed: May 28, 2009

(86) PCT No.: PCT/ES2009/000294

§ 371 (c)(1),
(2), (4) Date: Dec. 16, 2011

(87) PCT Pub. No.: WO2010/136610

PCT Pub. Date: Dec. 2, 2010

(65) Prior Publication Data

US 2012/0096733 A1 Apr. 26, 2012

(51) Int. Cl.

| | |
|---|---|
| ***D06F 58/00*** | (2006.01) |
| ***D06F 58/02*** | (2006.01) |
| ***D06F 58/04*** | (2006.01) |
| ***D06F 58/20*** | (2006.01) |

(52) U.S. Cl.

CPC ..... *D06F 58/02* (2013.01); *D06F 58/04* (2013.01); *D06F 58/20* (2013.01)

USPC ..... 34/108; 34/136; 34/137; 34/141

(58) Field of Classification Search

CPC ..... D06F 58/00; D06F 58/02; D06F 58/04

USPC ..... 34/108, 136, 137, 141

See application file for complete search history.

(56) References Cited

U.S. PATENT DOCUMENTS

| | | | | |
|---|---|---|---|---|
| 2,079,280 | A * | 5/1937 | Conch | 34/131 |
| 3,364,588 | A * | 1/1968 | Ziegler | 34/573 |
| 3,902,254 | A * | 9/1975 | Files | 34/126 |
| 4,593,481 | A | 6/1986 | Pellerin | |
| 2007/0017119 | A1 | 1/2007 | Besaw | |
| 2009/0260256 | A1 * | 10/2009 | Beaulac | 34/528 |

FOREIGN PATENT DOCUMENTS

| | | | |
|---|---|---|---|
| EP | 1405946 | A2 | 4/2004 |
| EP | 1600548 | A2 | 11/2005 |
| EP | 1905882 | A1 | 4/2008 |

(Continued)

*Primary Examiner* — Kenneth Rinehart
*Assistant Examiner* — Gajanan M Prabhu
(74) *Attorney, Agent, or Firm* — Hess Patent Law Firm LLC; Robert J. Hess

(57) ABSTRACT

A tunnel-type rotary drum tumble dryer includes a cabinet (1) with a loading door (2) and an unloading door (3) on opposite sides, and a drum (4) arranged inside the cabinet (1) for rotating with respect to a horizontal or inclined geometric axis (E). The drum (4) has a revolution wall (5) around the axis (E), and end openings (5*a*, 5*b*) at opposite ends facing said loading and unloading doors (2, 3). The tumble dryer also includes an air circulator that includes an air inlet (8) facing one of the end openings (5*a*, 5*b*) of the drum (4) and an air outlet (9) adjacent to the other end opening (5*a*, 5*b*) of the drum (4) for creating an axial flow of drying air inside and from one end to another of the drum (4) through the clothing tumbling inside the drum (4).

10 Claims, 4 Drawing Sheets

(56) References Cited

FOREIGN PATENT DOCUMENTS

| | | | |
|---|---|---|---|
| JP | 57086397 | A | 5/1982 |
| WO | 0212614 | A1 | 2/2002 |
| WO | 2008105232 | A1 | 9/2008 |
| WO | 2010136610 | A1 | 12/2010 |

* cited by examiner

TUNNEL-TYPE ROTARY-DRUM TUMBLE DRYER

FIELD OF THE ART

The present invention relates to a tunnel-type rotary drum tumble dryer where the drum is arranged for rotating with respect to a horizontal or inclined geometric axis and has a revolution wall around said geometric axis and end openings at opposite axial ends, and where the clothing to be dried is loaded into the drum through one of said end openings and unloaded through the other opposite end opening. The tumble dryer of the present invention has a special application in the industrial laundry field.

BACKGROUND OF THE INVENTION

Tumble dryers provided with a cabinet inside which there is installed a tunnel-type rotary drum arranged for rotating with respect to a horizontal or inclined geometric axis are well known in the prior art. The tunnel-type drum is provided with a perforated cylindrical wall and with end openings at opposite axial ends. These end openings of the drum are facing corresponding loading and unloading openings formed in the cabinet, which can be opened and closed by means of respective doors. Thus, the clothing to be dried can be introduced into the drum through a loading door at one end and extracted through an unloading door at the opposite end. The loading and unloading doors remain closed during a drying operation. Hot air circulation means which include a chamber surrounding the cylindrical wall of the drum connected to a suction device are configured for radially introducing hot air into the drum through the perforations located in an area of the cylindrical wall which is on one side, preferably an upper side, of the drum and extracting the hot air from the drum through the perforations located in an area of the cylindrical wall which is on an opposite side, preferably a lower side, of the drum while the drum rotates with the clothing tumbling therein. One drawback is that the passage area of the perforations is relatively small compared with the area of the cylindrical wall and this means that the hot air circulation through the perforations is not very efficient and that a large part of the flow circulates around the drum without penetrating therein.

Patent EP-A-1318226 describes a tumble dryer of the type described above in which the drum has a perforated revolution wall revolving around the geometric axis of rotation and wherein any generatrix of said revolution wall, when it is located at the lowest level of the drum, is inclined with respect to the horizontal, with an end adjacent to the inlet door more elevated than an end adjacent to the outlet door. Oblique blades with respect to any generatrix are fixed on a surface inside the drum and they are oriented such that when the drum rotates in a drying direction, the effect of the inclination of the blades offsets a tendency of the clothing to move by gravity towards the outlet door keeping the clothing inside the drum, and when the drum rotates in an opposite unloading direction, the effect of the inclination of the blades is added to said tendency of the clothing to move by gravity towards the outlet door to carry out an automatic operation for unloading the clothing from the drum.

U.S. Pat. No. 4,593,481 discloses a tunnel-type rotary drum tumble dryer wherein the drum which is arranged for rotating with respect to a generally horizontal geometric axis has a cylindrical wall and end openings at opposite ends. The cylindrical wall of the drum has perforated annular portions located on opposite sides of a non-perforated annular portion, and the dryer includes means for circulating hot air radially into the drum through the perforations of one of the perforated annular portions, then axially along the non-perforated annular portion and through the items to be dried, and then radially out of the drum through the perforations of the other perforated annular portion. One drawback of this construction is that the items to be dried, which, as a result of the rotation of the drum tumble on the areas of the drum which are at a lower level, have the tendency to block the perforations of the wall of the drum in these areas located at a lower level forcing the hot air to enter and exit the drum through the perforations of the areas of the drum which are at a higher level, which makes it difficult for the hot air circulating inside the drum to pass through the clothing to be dried and this reduces dryer efficiency.

DISCLOSURE OF THE INVENTION

The present invention contributes to mitigate the foregoing and other drawbacks by providing a tunnel-type rotary drum tumble dryer of the type comprising a cabinet with a loading door on one side and an unloading door on another opposite side. Inside said cabinet there is a drum for containing clothing to be dried arranged for rotating with respect to a horizontal or inclined geometric axis. The mentioned drum has a revolution wall around said geometric axis and end openings at opposite axial ends of the drum facing said loading and unloading doors. The dryer further includes driving means for rotating the drum and air circulation means for introducing and extracting drying air into/from the drum while the latter rotates with clothing tumbling therein. The dryer of the present invention is characterized in that said air circulation means comprise at least one air inlet facing one of said end openings of the drum and in communication with the inside thereof, and at least one air outlet adjacent to the other end opening of the drum and in communication with the inside thereof for creating a flow of drying air inside the drum and in the axial direction thereof substantially from one end to another through the clothing tumbling inside the drum. The mentioned air outlet is located in a position selected so as to extract air only from a region of the drum located at a lower level than the geometric axis, whereas said air inlet can be alternatively located so as to introduce drying air into a region of the drum located above the geometric axis, even though arranging it so as to introduce drying air into a region of the drum located at a lower level than the geometric axis is also preferred.

The air circulation means comprise an air inlet duct in communication with the air inlet and generally connected to an air heating device and an air outlet duct in communication with the air outlet and connected to a suction device through an air filtering device. The moist and hot air coming from the air outlet can be discharged into the atmosphere or recycled again towards the air inlet through the air heating device.

The air inlet can be formed in the loading door or in the unloading door of the cabinet in a position selected so as to be facing the corresponding end opening of the drum when the loading door or the unloading door is closed, or alternatively the air inlet can be formed in a wall of the cabinet located on the same side where the loading door or the unloading door is located, in a position facing the corresponding end opening of the drum. Similarly, the air outlet can be formed in the loading door or in the unloading door of the cabinet in a position selected so as to be facing the corresponding end opening of the drum when the loading door or the unloading door is closed, or alternatively the air outlet can be formed in a wall of the cabinet on the same side where the loading door or the unloading door is located, in a position facing the corresponding end opening of the drum. Alternatively, the air outlet can be formed by a plurality of perforations in a perforated annular region of said revolution wall of the drum adjacent to the corresponding end opening facing the loading door or the unloading door, and this perforated annular region of the revolution wall is in communication with an air outlet chamber covering only one arch of the perforated annular region of the revolution wall located at a lower level than the geometric axis.

When the air inlet is located in or adjacent to the loading door and the air outlet is located in or adjacent to the unloading door, the flow of air inside the drum and the circulation of the clothing through the drum are produced in the same axial direction, whereas when the air inlet is located in or adjacent to the unloading door and the air outlet is located in or adjacent to the loading door, the flow of air inside the drum and the circulation of the clothing through the drum are produced in opposite axial directions.

The flow of drying air from the air inlet to the air outlet inside the drum in an axial direction through the clothing tumbling therein provides a more effective drying action with less energy expenditure in the tumble dryer of the present invention compared with dryers of the prior art. The present invention further contemplates using the air inlet and outlet arrangement creating a flow of air inside the drum in an axial direction opposite the movement of the clothing in combination with an inclined arrangement of the drum to provide an automatic device for unloading the clothing from the drum.

Thus, in one embodiment, the drum is configured and arranged such that any generatrix of the revolution wall of the drum which is at the lowest level of the drum is inclined with an end adjacent to the end opening facing the loading door more elevated than the other end adjacent to the end opening facing the unloading door. This can be achieved for example by means of a cylindrical revolution wall arranged with the geometric axis inclined with respect to the horizontal or by means of a frustoconical revolution wall arranged with the geometric axis horizontal or inclined with respect to the horizontal. Due to the mentioned inclination of the lower generatrix of the drum, during a drying operation and as a result of the rotation of the drum the clothing has the tendency to move towards the end opening of the drum facing the unloading door, and the flow of drying air inside the drum in the axial direction from the end adjacent to the unloading door to the end adjacent to the loading door offsets said tendency of the clothing to move towards the end opening of the drum facing the unloading door and keeps the clothing tumbling inside the drum. Once the clothing is dry, with the air circulation means stopped and the unloading door open, the simple rotation of the drum in the absence of the flow of air in the opposite direction moves the clothing towards the unloading door and automatically unloads the clothing from the drum.

This automatic unloading device can be used in combination with oblique or helical inner blades fixed to an inner surface of the revolution wall of the drum contributing to offset the tendency of the clothing to move towards the end opening facing the unloading door when the drum rotates in a first direction and contributing to increase the tendency of the clothing to move towards the end opening facing the unloading door when the drum rotates in a second opposite direction.

BRIEF DESCRIPTION OF THE DRAWINGS

The foregoing and other features and advantages will be better understood from the following detailed description of exemplary embodiments in reference to the attached drawings, in which.

DETAILED DESCRIPTION OF EXEMPLARY EMBODIMENTS

Figure 1:
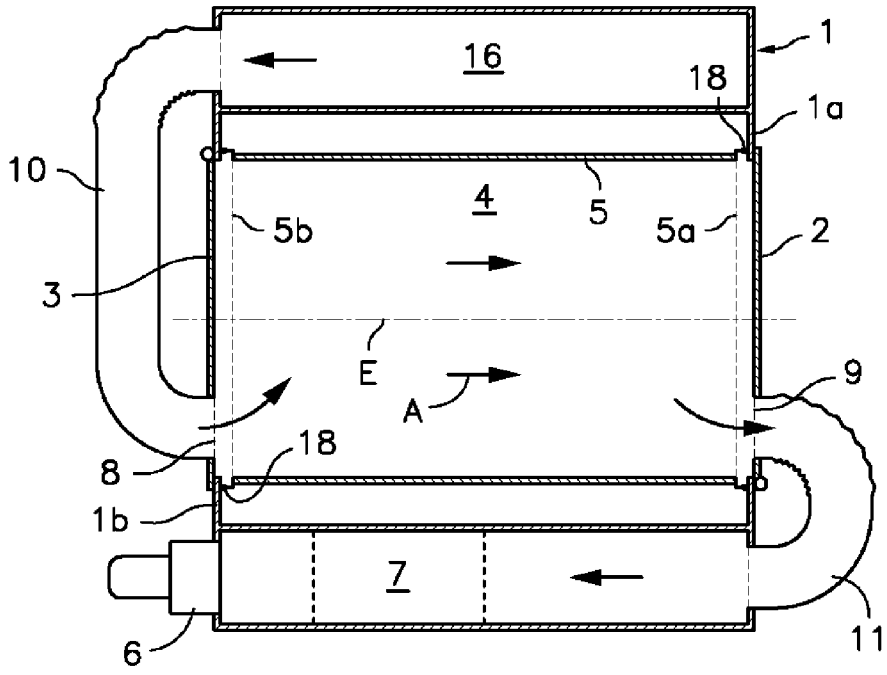
FIG. 1 is a side schematic cross-sectional view of a tunnel-type rotary drum tumble dryer according to a first embodiment of the present invention in a drying condition.
Figure 2:
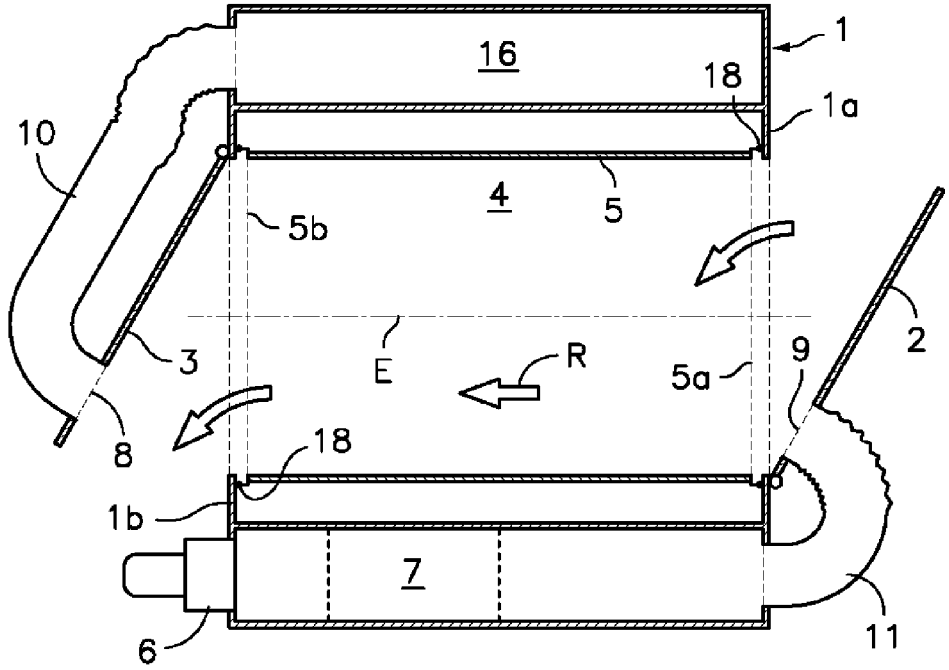
FIG. 2 is a side schematic cross-sectional view of the tumble dryer of FIG. 1 in a loading and/or unloading condition.

First referring to FIGS. 1 and 2, the tunnel-type rotary drum tumble dryer according to the first embodiment of the present invention comprises a cabinet 1 having an upper wall, a lower wall and opposite lateral walls 1*a*, 1*b* in which respective opposite loading and unloading openings are formed. The mentioned loading opening on one side can be closed by means of a loading door 2 and said unloading opening on the opposite side can be closed by means of an unloading door 3. Inside said cabinet 1 there is arranged a drum 4 for containing clothing to be dried which can rotate with respect to a horizontal geometric axis E under the action of driving means. The mentioned drum 4 has a revolution wall 5 around said geometric axis E and end openings 5*a*, 5*b* at opposite ends. One of said end openings 5*a* of the drum 4 is facing the loading door 2 and the other end opening 5*b* is facing the unloading door 3. End edges of the revolution wall 5 revolving around the end openings 5*a*, 5*b* of the drum 4 are very close to the respective lateral walls la, lb of the cabinet 1 and/or dynamic sealing gaskets 18 are arranged between said end edges of the revolution wall 5 of the drum 4 and the lateral walls la, lb of the cabinet 1 for maximally restricting the passage of air.

In this first embodiment, loading door 2 and unloading door 3 substantially cover the entire extension of the corresponding end openings 5*a* and 5*b* of the drum 4. To facilitate loading and unloading operations, the loading door 2 can pivot with respect to a horizontal axis located at the lower end thereof and the unloading door can pivot with respect to a horizontal axis located at the upper end thereof. When loading door 2 and unloading door 3 are open (FIG. 2), an amount of clothing to be dried can be introduced into the drum 4 through the loading door 2 and extracted from the drum 4 through the unloading door 3 following a path indicated by means of several hollow arrows R. When loading door 2 and unloading door 3 are closed (FIG. 1), the amount of clothing to be dried is kept tumbling inside the drum 4 as a result of a rotational movement of the drum 4.

The tumble dryer further comprises air circulation means for introducing and extracting drying air into/from the drum 4 while the latter rotates with clothing tumbling therein. The mentioned air circulation means comprise an air inlet 8 facing one of the end openings 5*b* of the drum 4 and in communication with the inside thereof, and at least one air outlet 9 facing the other end opening 5*a* of the drum 4 and in communication with the inside thereof. The mentioned air inlet 8 is connected to an air inlet duct 10, which in turn is connected with an air heating device 16 housed, for example, in an upper compartment of the cabinet 1. The mentioned air outlet 9 is connected to an air outlet duct 11 which in turn is connected to a suction device 6 through an air filtering device 7. The mentioned suction device 6 and filtering device 7 can be housed, for example, in a lower compartment of the cabinet 1. Thus, the air circulation means create a flow of drying air indicated by means of simples arrows A in FIG. 1 inside the drum 4 from the air inlet 8 to the air outlet 9 in the axial direction of the drum 4 and substantially from one end to another of the drum 4 through the clothing tumbling therein.

As is shown in FIGS. 1 and 2, in this first embodiment, the air inlet 8 comprises an opening formed directly in the unloading door 3 of the cabinet 1 and located in a position selected so as to be facing the corresponding end opening 5*b* of the drum 4 when the unloading door 3 is closed. Similarly, the air outlet 9 comprises an opening formed directly in said loading door 2 of the cabinet 1 and located in a position selected so as to be facing the corresponding end opening 5*a* of the drum 4 when the loading door 2 is closed. The flow of air A thus moves in an axial direction opposite to the movement of the clothing R. Both the air inlet 8 and the air outlet 9 are located in positions selected for introducing and extracting air, respectively, only into/from a region of the drum 4 located at a lower level than the geometric axis E to assure that the flow of air passes through the clothing tumbling inside the drum 4 in the lower region thereof. The air inlet duct 10 and air outlet duct 11 are flexible ducts, or have flexible or articulated parts, to allow opening and closing the doors of the air inlet 8 and air outlet 9, respectively. It will be understood that, alternatively, the air inlet 8 could be formed in the loading door 2 and the air outlet 9 could be formed in the unloading door 3 for creating a flow of air A in the same axial direction as the movement of the clothing R with a similar result.

Figure 3:
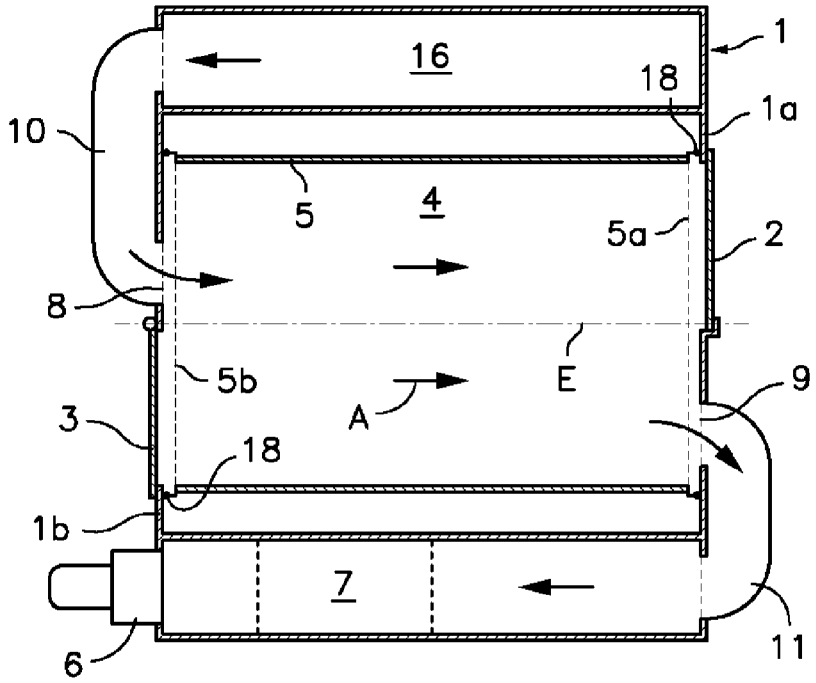
FIG. 3 is a side schematic cross-sectional view of a tunnel-type rotary drum tumble dryer according to a second embodiment of the present invention in a drying condition.
Figure 4:
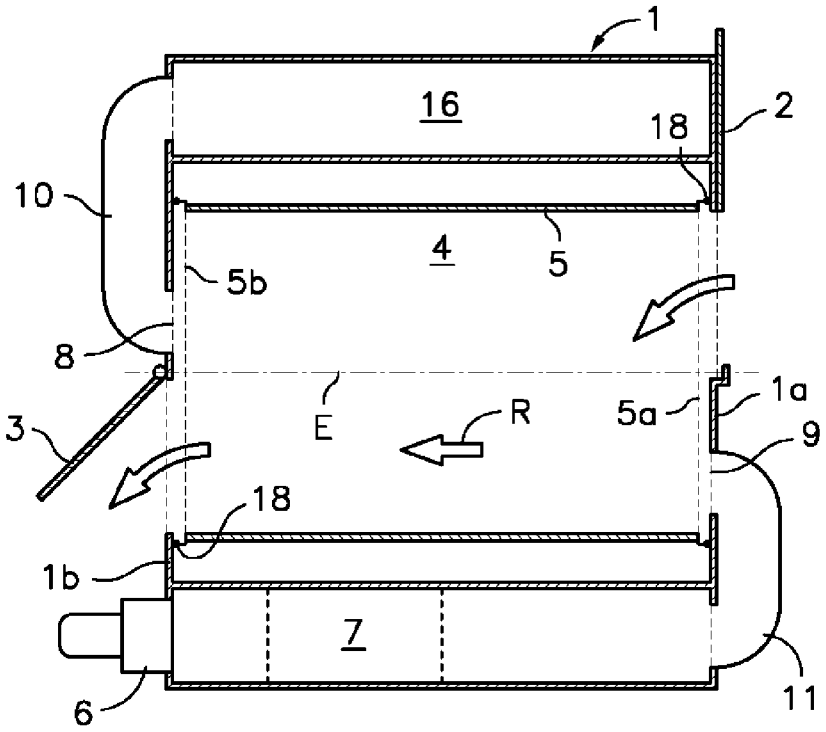
FIG. 4 is a side schematic cross-sectional view of the tumble dryer of FIG. 3 in a loading and/or unloading condition.

The second embodiment shown in FIGS. 3 and 4 is entirely similar to the first embodiment except that herein the loading door 2 only covers an upper portion of the corresponding end opening 5*a* of the drum and the rest of the end opening 5*a* of the drum 4 is permanently closed with the corresponding lateral wall la of the cabinet 1, whereas the unloading door 3 covers only a lower portion of the corresponding end opening 5*b* of the drum 4 and the rest of the end opening 5*b* of the drum 4 is permanently closed with the corresponding lateral wall lb of the cabinet 1. To facilitate the loading and unloading operations, the loading door 2 is a vertically sliding door and the unloading door can pivot with respect to a horizontal axis located at the upper end thereof. Thus, when loading door 2 and unloading door 3 are open (FIG. 4), an amount of clothing to be dried can be introduced into the drum 4 through the loading door 2 and extracted from the drum 4 through the unloading door 3 following a path indicated by means of hollow arrows R. When loading door 2 and unloading door 3 are closed (FIG. 3), the amount of clothing to be dried is kept tumbling inside the drum 4 as a result of a rotational movement of the drum 4.

In this second embodiment, the air inlet 8 comprises an opening formed in the lateral wall lb of the cabinet 1 located above the unloading door 3 and in a position directly facing the corresponding end opening 5*b* of the drum 4. The air outlet 9 comprises an opening formed in the lateral wall la of the cabinet 1 below the loading door 2 and facing the corresponding end opening 5*a* of the drum 4. The flow of air A thus moves in an axial direction opposite the movement of the clothing R. In this case only the air outlet 9 is located in a position selected so as to extract drying air from a region of the drum 4 located at a lower level than the geometric axis E, even though this is sufficient to assure that the flow of air passes through the clothing tumbling inside the drum 4 in the lower region thereof. This second embodiment has the advantage that the air inlet duct 10 and air outlet duct 11 can be rigid ducts since the air inlet door 8 and air outlet door 9 are left clear so that they can be opened and closed. It will be understood that, alternatively, the air inlet 8 could be formed in the lateral wall la below the loading door 2 and the air outlet 9 could be formed in the lateral wall lb above the unloading door 3 for creating a flow of air A in the same axial direction as the movement of the clothing R with a similar result.

Figure 5:
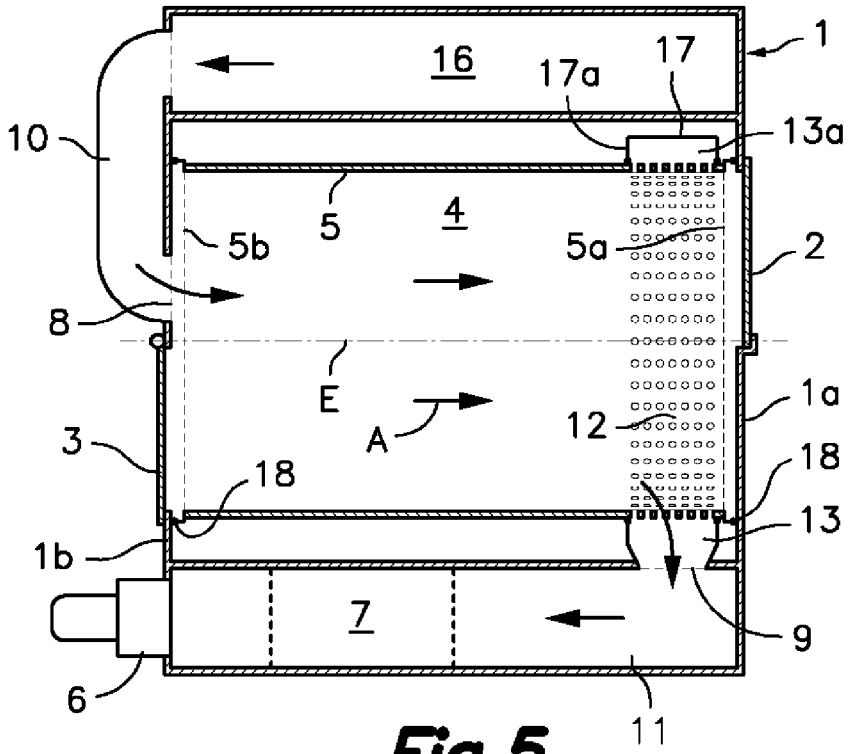
FIG. 5 is a side schematic cross-sectional view of a tunnel-type rotary drum tumble dryer according to a third embodiment of the present invention in a drying condition.
Figure 6:
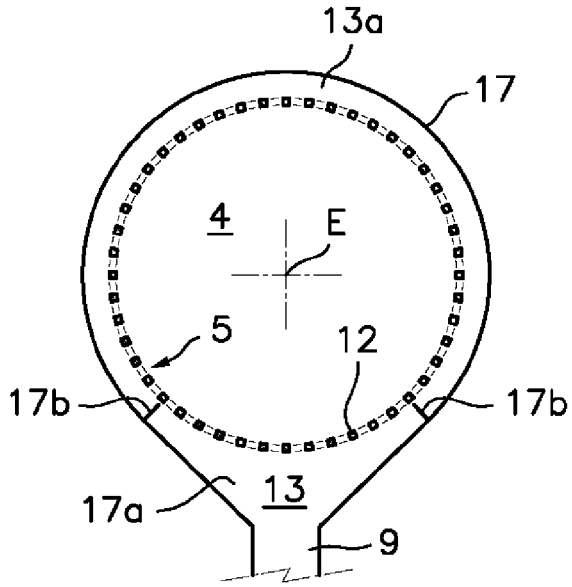
FIG. 6 is a front schematic cross-sectional view illustrating an air outlet chamber of the third embodiment shown in FIG. 5.

FIGS. 5 and 6 describe a third embodiment of the tumble dryer of the present invention which is entirely similar to the second embodiment shown in FIGS. 3 and 4 except that herein the air outlet 9 is carried out in one or more radial directions. Thus, in this third embodiment, the air outlet 9 is arranged in an air outlet chamber 13 in communication with a plurality of perforations formed in a perforated annular region 12 of the revolution wall 5. The mentioned air outlet chamber 13 covers only an arch of the perforated annular region 12 of the revolution wall 5 located at a lower level than the geometric axis E (FIG. 6) to force the drying air to pass through the clothing tumbling inside the drum 4 on the lower region of the revolution wall 5. The mentioned perforated annular region 12 of the revolution wall 5 of the drum 4 is located adjacent to the end opening 5*a* opposite the end opening 5*b* facing the air inlet 8 to force the flow of air A to move in an axial direction inside the drum 4 substantially from one end to another of the drum 4.

FIG. 6 shows by way of example a possible construction for the air outlet chamber 13. A surrounding wall 17 is arranged in a stationary manner around the perforated annular region 12 of the revolution wall 5 of the drum 4, and lateral closing walls 17*a* extend from the edges of said surrounding wall 17, each of which has a circular edge very close to an outer surface of the revolution wall 5 at either side of the perforated annular region 12, forming a chamber 13-13*a* all around the perforated annular region 12 of the revolution wall 5. Although it is not essential on account of the characteristics of the flow of drying air, a dynamic sealing gasket is preferably arranged between the circular edge of each lateral closing wall 17*a* and the revolution wall 5. Inside the mentioned chamber 13-13*a* and at a lower level than the geometric axis E, there is a pair of dividing walls 17*b* transversally fixed to the surrounding wall 17 and to the lateral closing walls 17*a*. Each of these dividing walls 17*b* has an edge very close to the outer surface of the revolution wall 5 such that the two dividing walls 17*b* divide the chamber 13-13*a* into the mentioned air outlet chamber 13 arranged at a lower level than the geometric axis E and in communication with the perforations of a lower portion of the perforated annular region 12 of the revolution wall 5 and with the air outlet 9, and a substantially blind seal chamber 13*a* in communication with the perforations of an upper portion of the perforated annular region 12 of the revolution wall 5.

Thus, since the seal chamber 13*a* is not connected to an air outlet, substantially all the drying air flowing axially along the drum 4 will be extracted through the perforations of that portion of the perforated annular region 12 of the revolution wall 5 which is facing the air outlet chamber 13 upon rotating the drum 4, through the air outlet chamber 13 and through the air outlet 9. Given the characteristics of the flow of drying air the incorporation of sealing gaskets between the free edges of the dividing walls 17*b* and the outer surface of the revolution wall 5 is not thought to be essential, even though brush-type gaskets type or the like could be installed there. In this embodiment and in any of those described above it may be convenient to install dynamic sealing gaskets between the end edges of the revolution wall 5 of the drum 4 and the inner surfaces of the lateral walls la, lb of the cabinet 1 and/or of the loading and unloading doors 2, 3.

A person skilled in the art will understand that it is possible to make multiple variants from the first, second and third embodiments described above. For example, the air inlet 8 installed in the unloading door 3 (on the left in FIGS. 1 and 2) could be combined with the air outlet 9 installed in the lateral wall la of the cabinet 1 adjacent to the loading door 2 (on the right in FIGS. 3 and 4) or with the air outlet 9 in communication with the air outlet chamber 13 facing the perforated region 12 of the revolution wall 5 of the drum 4 adjacent to the loading door 2 (on the right in FIG. 5). The air inlet 8 installed in the lateral wall lb of the cabinet 1 adjacent to the unloading door 3 (on the left in FIGS. 3 and 4) could also be combined with the air outlet 9 installed in the loading door 2 (on the right in FIGS. 1 and 2). In all the embodiments and variants described up until now, the flow of drying air A moves inside the drum 4 in an axial direction opposite the movement of the clothing R. Nevertheless, there is also within the scope of the present invention a similar number of embodiments and variants (not shown) where the air inlet 8 is installed in the loading door 2 or in the lateral wall la of the cabinet 1 adjacent to the loading door 2 and the air outlet 9 is installed in the unloading door 3 or in the lateral wall lb of the cabinet 1 adjacent to the unloading door 3, or in communication with an air outlet chamber 13 facing a perforated region 12 of the revolution wall 5 of the drum 4 adjacent to the unloading door 3 for creating the flow of drying air A being moved inside the drum 4 in the same axial direction as the movement of the clothing R.

Figure 7:
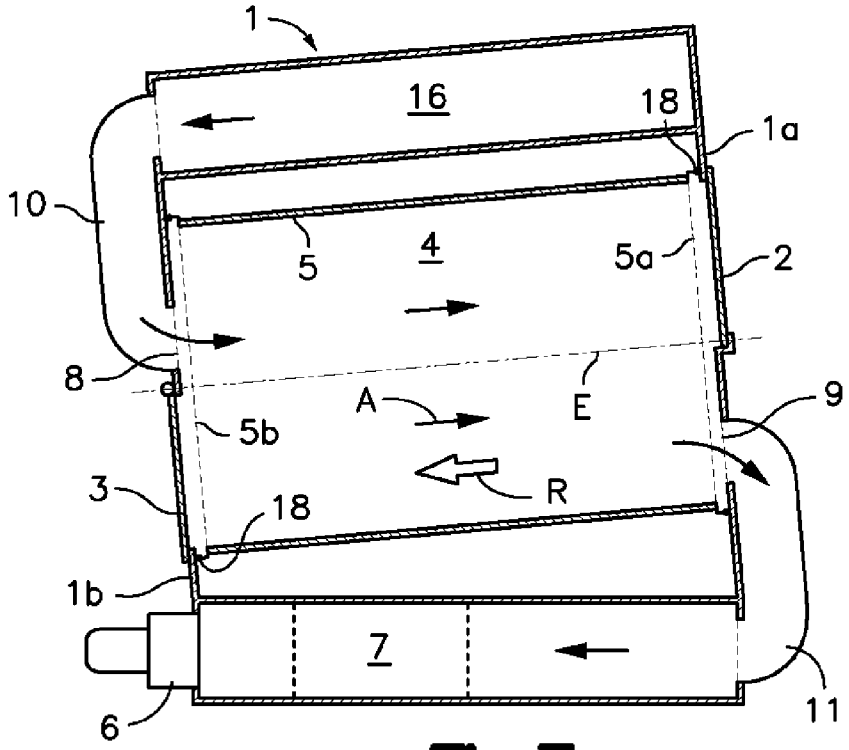
FIG. 7 is a side schematic cross-sectional view of a tunnel-type rotary drum tumble dryer according to a fourth embodiment of the present invention in a drying condition.

FIG. 7 further describes a fourth embodiment of the tumble dryer of the present invention which is entirely identical to the second embodiment described above in relation to FIGS. 3 and 4 except that herein the drum 4 is configured and arranged such that any generatrix 14 of the revolution wall 5 which is at the lowest level of the drum 4 has an end adjacent to the end opening 5*a* facing the loading door 2 more elevated than the other end adjacent to the end opening 5*b* facing the unloading door 3. In the example shown in FIG. 7 this is achieved by means of a drum 4 with a cylindrical revolution wall 5 supported for rotating around an inclined geometric axis. Alternatively, a similar effect can be achieved by means of a drum 4 with a frustoconical revolution wall 5 supported for rotating around a horizontal or inclined geometric axis.

Thus, during a drying operation, the clothing has a tendency to move by gravity downwards in the direction indicated by the arrow R towards the end opening 5*b* of the drum 4 facing the unloading door 3, and the flow of drying air A created by the air circulation means inside the drum 4 in the axial direction from the end adjacent to the unloading door 3 to the end adjacent to the loading door 2 counter-current to the movement of the clothing R offsets said tendency of the clothing to move towards the end opening 5*b* facing the unloading door 3 and the clothing is kept tumbling inside the drum 4 on the lower portion of the revolution wall 5 under the incidence of the flow of drying air A. During an unloading operation, the rotation of the drum 4 combined with the inclined position of the lower generatrix of the revolution wall 5 facilitates unloading the clothing through the unloading door 3.

Figure 8:
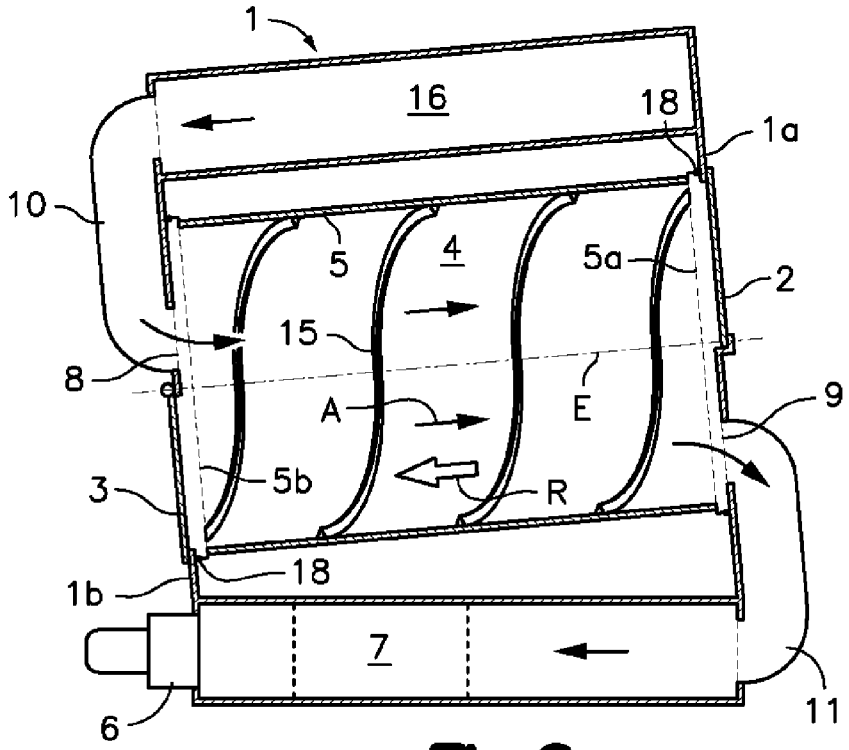
FIG. 8 is a side schematic cross-sectional view of a tunnel-type rotary drum tumble dryer according to a fifth embodiment of the present invention in a drying condition.

FIG. 8 shows a fifth embodiment of the tumble dryer of the present invention which has the same features as the fourth embodiment described in relation to FIG. 7 with the addition of oblique inner blades 15 with respect to the geometric axis E, or helical inner blades fixed to the inner surface of the revolution wall 5 of the drum 4. These oblique or helical inner blades 15 contribute to offset the tendency of the clothing to move towards the end opening 5*b* of the drum 4 facing the unloading door 3 when the drum 4 rotates in a first direction during a drying operation in addition to the effect of the flow of drying air A, and contribute to increase the tendency of the clothing to move towards the end opening 5*b* facing the unloading door 3 when the drum 4 rotates in a second opposite direction during an unloading operation.

It will be understood that the arrangement of the loading and unloading doors 2, 3 and of the air inlet and outlet 8, 9 in the fourth and fifth embodiments described in relation to FIGS. 7 and 8, respectively, could alternatively be in accordance with what has been described above in relation to any one of the first, second and third embodiments or any one of their variants.

A person skilled in the art will be capable of introducing modifications and variations from the embodiments shown and described without departing from the scope of the present invention as defined in the attached claims.

The invention claimed is:

1. A tunnel-type rotary drum tumble dryer comprising:

a cabinet with a loading door on one side and an unloading door on another opposite side;

a drum for containing clothing to be dried arranged inside said cabinet for rotating with respect to a horizontal or inclined geometric axis, said drum having a revolution wall around said geometric axis, and end openings at opposite ends of the drum facing said loading and unloading doors;

driving means for rotating the drum; and air circulation means for introducing and extracting drying air into and from the drum respectively while the latter rotates with clothing therein, said air circulation means comprising at least one air inlet facing one of said end openings of the drum and in communication with the inside thereof, and at least one air outlet facing the other end opening of the drum and in communication with the inside thereof for creating a flow of drying air inside the drum in the axial direction thereof substantially from one end to another through the clothing tumbling inside the drum, wherein said air outlet comprises an opening formed in a lateral wall of the cabinet adjacent to said loading door and the air inlet comprises an opening formed in said unloading door of the cabinet and in a position selected to be facing the corresponding end opening of the drum when the unloading door is closed.

2. The dryer according to claim 1, wherein at least said air outlet is located in a position selected so as to extract air only from a region of the drum located at a lower level than the geometric axis.

3. The dryer according to claim 1, wherein the air inlet is located at a lower level than the geometric axis.

4. The dryer according to claim 1, wherein the air circulation means comprise an air inlet duct in communication with the air inlet and an air outlet duct in communication with the air outlet and connected to a suction device through an air filtering device.

5. The dryer according to claim 1, wherein the drum is configured and arranged such that any generatrix of the revolution wall which is at the lowest level of the drum has an end adjacent to the end opening facing the loading door more elevated than the other adjacent to the end opening facing the unloading door, such that during a drying operation the clothing has the tendency to move towards the end opening facing the unloading door, and the air circulation means are arranged for making the flow of drying air flow axially inside the drum from the end adjacent to the unloading door to the end adjacent to the loading door to offset said tendency of the clothing to move towards the end opening facing the unloading door.

6. The dryer according to claim 5, wherein the revolution wall includes oblique or helical inner blades contributing to offset the tendency of the clothing to move towards the end opening facing the unloading door when the drum rotates in a first direction and contributing to increase the tendency of the clothing to move towards the end opening facing the unloading door when the drum rotates in a second opposite direction.

7. The dryer according to claim 2, wherein the air circulation means comprise an air inlet duct in communication with the air inlet and an air outlet duct in communication with the air outlet and connected to a suction device through an air filtering device.

8. The dryer according to claim 2, wherein the drum is configured and arranged such that any generatrix of the revolution wall which is at the lowest level of the drum has an end adjacent to the end opening facing the loading door more elevated than the other adjacent to the end opening facing the unloading door, such that during a drying operation the clothing has the tendency to move towards the end opening facing the unloading door, and the air circulation means are arranged for making the flow of drying air flow axially inside the drum from the end adjacent to the unloading door to the end adjacent to the loading door to offset said tendency of the clothing to move towards the end opening facing the unloading door.

9. The dryer according to claim 8, wherein the revolution wall includes oblique or helical inner blades contributing to offset the tendency of the clothing to move towards the end opening facing the unloading door when the drum rotates in a first direction and contributing to increase the tendency of the clothing to move towards the end opening facing the unloading door when the drum rotates in a second opposite direction.

10. The dryer according to claim 2, wherein the air inlet is located at a lower level than the geometric axis.

* * * * *